United States Patent [19]

Hockaday

[11] Patent Number: 4,722,365

[45] Date of Patent: Feb. 2, 1988

[54] FLUIDIC DEVICE

[75] Inventor: Bruce D. Hockaday, Vernon, Conn.

[73] Assignee: United Technologies Corporation, Hartford, Conn.

[21] Appl. No.: 812,089

[22] Filed: Dec. 23, 1985

[51] Int. Cl.[4] ..... F15C 1/04; F15C 1/08

[52] U.S. Cl. ..... 137/828; 137/840

[58] Field of Search ..... 137/828, 821, 840; 250/351, 353

[56] References Cited

U.S. PATENT DOCUMENTS

| | | | |
|---|---|---|---|
| 3,228,411 | 1/1966 | Straub | 137/827 |
| 3,591,809 | 7/1971 | Laakaniemi | 137/827 |
| 3,721,255 | 3/1973 | Suzuki et al. | 137/828 |
| 4,512,371 | 4/1985 | Drzewiecki et al. | 137/828 |

*Primary Examiner*—A. Michael Chambers

*Attorney, Agent, or Firm*—J. Swiatocha

[57] ABSTRACT

A focused optical input signal is applied to an optically absorbent wall portion of one of two convergent supply nozzles in a fluidic device to reduce the thickness of the flow boundary layer. The boundary layer reduction deflects the combined nozzle discharge to achieve a desired output from the device.

6 Claims, 3 Drawing Figures

FIG. 1
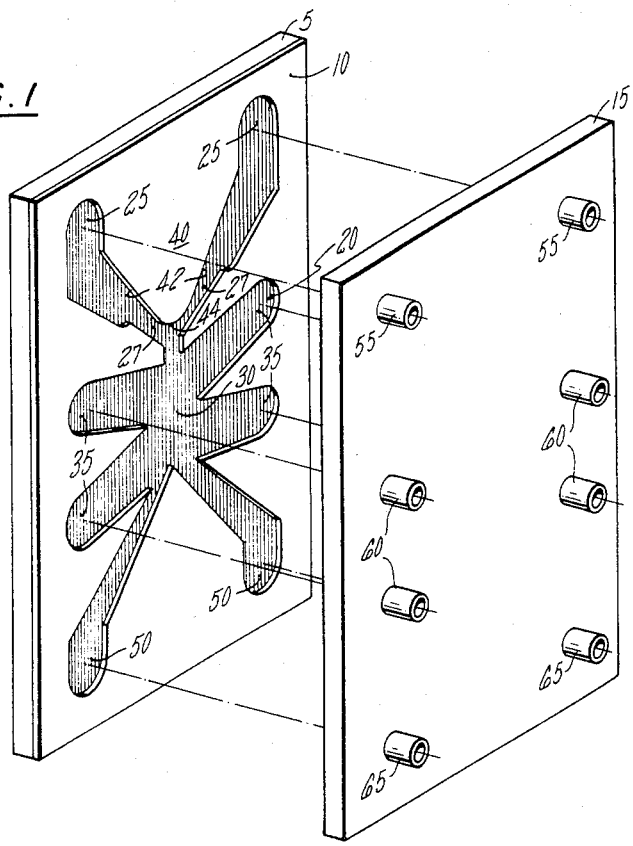
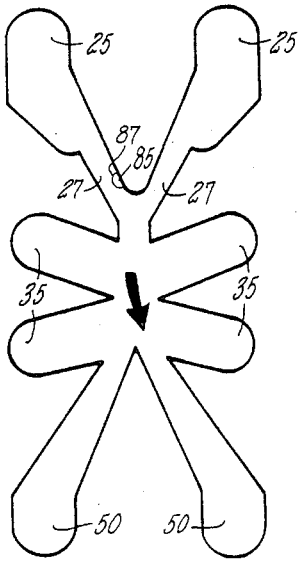
FIG. 3

FLUIDIC DEVICE

CROSS REFERENCE

This invention relates to U.S. patent application Ser. No. 741,045 filed June 4, 1985 and entitled FLUIDIC DEVICE, and U.S. patent application Ser. No. 741,085 filed June 4, 1985 and entitled FLUIDIC DEVICE now U.S. Pat. No. 4,606,375 issued Aug. 13, 1986.

TECHNICAL FIELD

This invention relates generally to fluidic devices and more particularly to a device which converts an optical input signal to a fluidic output signal.

BACKGROUND ART

Electrical and pneumatic systems for industrial and aeronautical control are well known in the art. Recently, however, optical systems have received increasing attention as possible alternatives to such electrical and pneumatic control systems. In industrial applications, optical controls tend to be inherently more safe, immune to electromagnetic noise and lower in cost than corresponding electrical systems. Also, optical fibers weigh less, are more compact and provide a larger signal bandwidth than pneumatic or electrical control lines. The benefits offered by optical control systems are particularly noteworthy in aeronautical applications. In military aircraft, for example, optical controls are more survivable in the presence of electromagnetic interference, electromagnetic pulses, electrostatic interference and high-energy particles than functionally similar electrical systems.

While optical control system components such as optical power sources, optical fiber transmission lines and connectors therefor are currently available for control system applications, hardware for converting optical input signals to fluid mechanical output signals, as would be necessary for the optical control of such apparatus as hydraulic motors and the like, have yet to be developed appreciably.

DISCLOSURE OF INVENTION

It is therefore, a principal object of the present invention to provide an improved opto-fluidic interface for converting optical input signals to fluidic output signals.

It is another object of the present invention to provide such an opto-fluidic device characterized by structural economy as well as operational simplicity and effectiveness.

It is another object of the present invention to provide such an opto-fluidic device with enhanced reliability.

It is another object of the present invention to provide such an opto-fluidic device which is readily adaptable for use with known fluidic control components.

These and other objects, which will become more readily apparent from the following detailed description, taken in connection with the appended claims and accompanying drawing, are attained by the fluidic control device of the present invention in which the fluidic output of the device is controlled by modulating flow conditions within the device by the application thereto of an optical input signal. In the preferred embodiment, the optical input signal is applied to an optically absorbent portion of one of two convergent inlet nozzles adjacent to an interior sidewall thereof. This application of optical energy heats that portion of the sidewall, lowering the viscosity of fluid flow therepast, thereby reducing the thickness of the boundary layer of the flow at that location. Reducing boundary layer thickness enhances attachment of the flow to the sidewall to effect a deflection of the combined output from both nozzles to achieve a desired fluidic output signal. The optical input signal may comprise a focused laser beam and the optically absorbent material a graphite-epoxy composite. The fluidic device may function as a fluidic amplifier (signal converter), which may be serially connected to additional amplifier stages in a cascade arrangement to achieve a desired output signal amplitude.

BRIEF DESCRIPTION OF THE DRAWING

FIG. 1 is an exploded perspective view of a fluid handling portion of the fluidic device of the present invention;

FIG. 3 is a schematic representation of the fluidic device shown in FIG. 1 under operating conditions.

BEST MODE OF CARRYING OUT THE INVENTION AND INDUSTRIAL APPLICABILITY THEREOF

Figure 2:
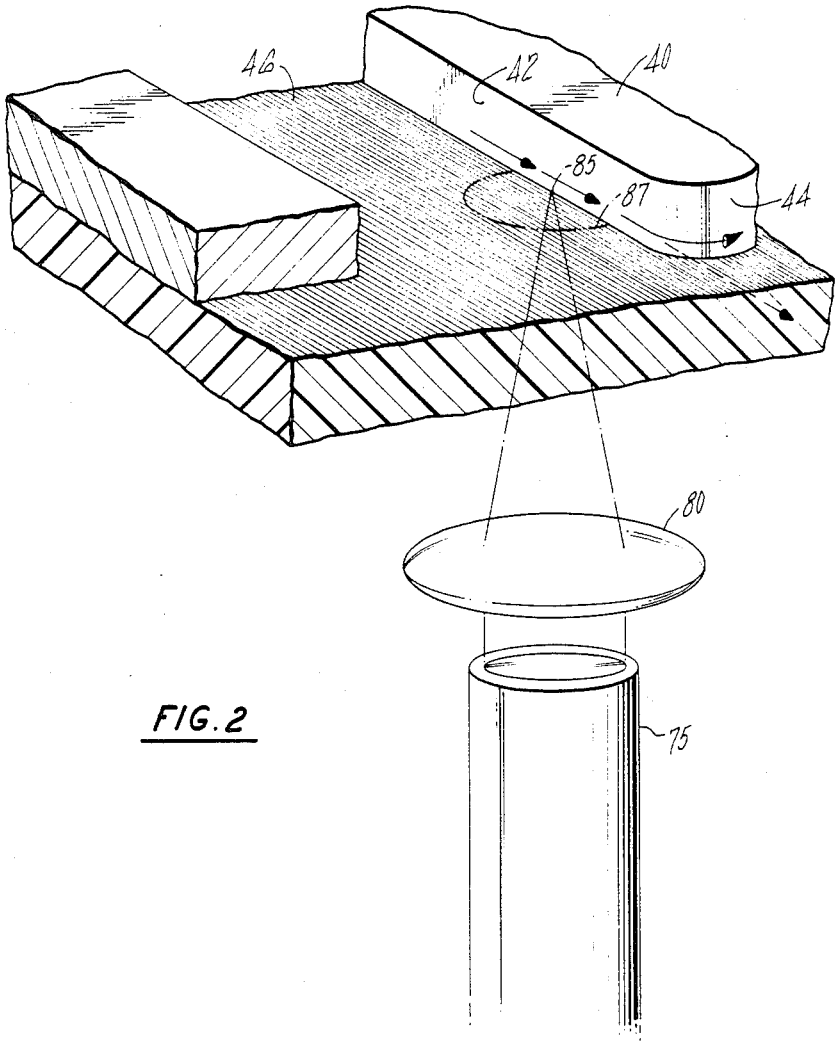
FIG. 2 is an enlarged, isometric, fragmentary view of part of that portion of the device shown in FIG. 1.

Referring to the drawing and particularly FIG. 1 thereof, the fluidic device of the present invention comprises a laminar arrangement of plates 5, 10 and 15, plate 5 being formed from, or coated on an interior surface thereof with an optically absorbent material such as a graphite-epoxy composite 20 having the graphite reinforcement fibers thereof disposed generally in parallel orientation to the fluid flow through the nozzles. Plate 10 has a network of flow passages provided therein either by machining, etching or equivalent techniques. As illustrated, supply passages 25 feed through supply nozzles 27, to an open area (interaction region) 30 between four generally symmetrically arranged vent passages 35. As illustrated, supply nozzles 27 are generally convergent, being separated by that portion of plate 10 comprising flow separator 40. Separator 40 comprises a pair of convergent sidewalls 42 (which comprise the sidewalls of nozzles 40) joined at a relatively blunt nose 44, all of which are in upstanding relationship to the bottom walls 46 of the nozzles, formed by the optically absorbent composite. Output passages 50, which are also etched in plate 10, communicate with region 30. Plate 15 is drilled and provided with a plurality of taps (ports) for making fluid connections to the various passages in plate 10. Thus, ports 55 connect supply passages 25 with suitable sources of pressurized fluid (not shown) while ports 60 communicate with vent passages 35. Ports 65 communicate with output passages 50.

The fluid handling portion of the fluidic device described hereinabove functions as a fluidic amplifier or signal converter. Thus, it will be seen that fluid introduced to inlet passages 25 through ports 55, flows through nozzles 27, through open region 30 between vent passages 35 and is split between output passages 50. Maintenance of a constant pressure within interaction region 30 is effected by selectively venting interaction region 30 at passages 35, through ports 60. Fluidic signal generation is achieved by controlling the flow conditions through nozzles 27, to turn some of the flow through the device toward one or the other of the output passages 50 to achieve a desired difference in pressure therebetween. Similarly, the device may function as a switch wherein the entire flow is diverted from one output passage 50 to the other. While in prior art fluidic amplifiers, such input signals are fluidically applied through control ports, with the present invention, the input signal comprises an optical signal applied directly to the nozzle sidewalls.

Referring to FIG. 2, the optical input signal to the fluidic device comprises a focused optical signal applied to a discrete location on the optically absorbent composite. The means for applying this signal comprises a source of light such as a laser, a light emitting diode or any fiber optically-conducted light source 75 and a collecting lens system, shown herein schematically by a single lens 80. Optical energy from the laser is focused by the lens system onto a point 85 on the optically absorbent composite. This focused optical energy heats an area 87 of the supply nozzle wall structure adjacent location 85 including the adjacent location of sidewall 42. The orientation of the graphite fibers generally parallel to the direction of flow, minimizes the conduction of heat through the composite, away from the sidewall. The effect of the sidewall heating causes a lowering of the viscosity of the fluid flowing past the heated area of the sidewall. Lowering the fluid viscosity in this manner reduces the thickness of the flow boundary layer at the heated wall area, thereby enhancing the degree to which the flow remains attached to the wall. As illustrated in FIG. 3, increasing the span of lefthand nozzle wall 42 to which the flow is attached, effects a turning of the flow in region 30 to the right, thereby establishing an imbalance in flow conditions between the output passages and defining a fluidic pressure output signal therebetween. Similarly, increasing the span of the inner wall in the right-hand nozzle to which the flow remains attached, effects a turning of the flow within region 30 to the left to establish a fluid pressure output signal of opposite magnitude between outlet passages 50 and outlet ports 65.

It will thus be apparent that the fluidic device of the present invention provides a uncomplicated yet effective and reliable control device for converting an optical input signal to a fluidic output signal. By the application of focused optical energy to a discrete location on an optically absorbent portion of one of two convergent nozzle sidewalls, flow conditions in the device and therefore imbalances between the output ports can be controlled. With appropriate sizing of the passages and optical input signal strength, a predetermined output (a predetermined pressure difference between the output ports) is reliably attained with accuracy and repeatability. Such accuracy and repeatability are further enhanced by the inherent insensitivity of the device to optical signal position along wall 42. It has been observed that the apparatus of the present invention is extremely sensitive to optical input signal position when the signal is applied at nose 44. That is, slight deviation in signal position results in significant deviation in output signal magnitude. However, the application of the optical input signal upstream from the nose results in an output signal relatively immune to minor discrepencies in input signal location along the wall, whereby the manufacturability of the device is enhanced.

Those skilled in the art will readily appreciate the innumerable applications for the present invention. For example, in "fly by light" aircraft control systems, optical input signals can be applied to fluidic devices such as that of the present invention and the output pressure difference of the device applied to such apparatus as hydraulic actuators to set the position of aircraft control surfaces and the like. It will also be noted that the fluidic device of the present invention is readily adaptable for use with similar fluidic devices such as known fluidic amplifiers for further amplification of the output signal across output ports 65. In such an arrangement, the output signal across ports 65 would be fed as an input signal to a second, state-of-the-art fluidic amplifier. With such an arrangement, fluidic input signals (output signals from ports 65) applied to a pressurized supply flow would result in amplification of the input signals at the output of the second amplifier. Further amplification (and if necessary, further control by way of fluidic control signals input to the amplifier control passages) would therefore be readily achieved by further cascading of the output signals with further stages of fluidic amplification.

While a particular embodiment of the present invention has been shown and described, it will be appreciated that the disclosure herein will suggest various alternate embodiments to those skilled in the art. Thus, while in the description herein, the optical input signal is applied to a single supply nozzle, it will be readily appreciated that an opposite output pressure signal may be achieved by directing the optical input signal to the other supply nozzle. Furthermore, while the optically absorbent material has been described as a graphite-epoxy composite, various other compositions such as carbon impregnated ceramic will also suggest themselves to those skilled in the art. Also, the optical input signal may be applied either to the back of plate 5 (as shown) or, if plate 15 is transparent, to the front of plate 5. Similarly, various other arrangements of fluidic passages adaptable to fluidic control by boundary layer reduction resulting from the application of an optical input signal to one of two optically absorbent supply nozzles may also suggest themselves to those skilled in the art. Therefore, it is intended by the following claims to cover any such alternate embodiments as fall within the true spirit and scope of this invention.

Having thus described the invention, what is claimed is:

1. In a fluidic device accommodating fluid flow therethrough, said fluidic device comprising a pair of outlet ports, a desired output of said fluidic device, defined by an imbalance in flow conditions between said outlet ports, being attained by the application of a control signal to said fluid flow for regulating the flow conditions thereof, the improvement characterized by:

a pair of supply nozzles accommodating said fluid flow therethrough and which exhaust, at optically absorbent portions thereof, to a common interaction region upstream from said outlet ports;

means separating said supply nozzles from one another at said optically absorbent portions thereof; and means for applying an optical input signal directly to one of said optically absorbent nozzle portions adjacent said separating means for reducing the boundary layer thickness of said fluid flow thereat, thereby enhancing the attachment of said flow to said separating means and deflecting the combined discharge of said nozzles within said interaction region for establishing said imbalance in flow conditions at said outlet ports.

2. The fluidic device of claim 1 characterized by said means for applying said focused optical input signal to said discrete location, comprising a source of light and a collecting lens system.

3. The fluidic device of claim 1 characterized by said outlet ports being disposed in relative juxtaposition and by said separating means comprising a pair of substantially convergent nozzle sidewalls upstanding from generally orthogonal nozzle walls formed from said optically absorbent material.

4. The fluidic device of claim 3 characterized by said convergent nozzle sidewalls being joined at a blunt nose portion.

5. The fluidic device of claim 1 characterized by said optically absorbent material comprising a composite including graphite fibers disposed in an epoxy matrix.

6. The fluidic device of claim 5 characterized by said graphite fibers being disposed in generally parallel orientation to said fluid flow.

* * * * *